US005155989A

United States Patent [19]

Frey et al.

[11] Patent Number: 5,155,989

[45] Date of Patent: Oct. 20, 1992

[54] METHOD OF AND APPARATUS FOR PRODUCING A BLENDED YARN FROM COTTON FIBERS AND MAN-MADE FIBERS

[75] Inventors: Manfred Frey, Seuzach; Reto Thom, Wiesendangen; Ludwig Lacher, Gebenstorf, all of Switzerland

[73] Assignee: Reiter Machine Works Ltd., Winterthur, Switzerland

[21] Appl. No.: 483,742

[22] Filed: Feb. 23, 1990

[30] Foreign Application Priority Data

Feb. 27, 1989 [CH] Switzerland ..... 00714/89

[51] Int. Cl.[5] ..... D01G 13/00; D02G 3/04

[52] U.S. Cl. ..... 57/327; 19/65 A; 19/145.5; 57/256

[58] Field of Search ..... 57/256, 252, 75, 362, 57/327; 19/65 A, 145.5, 145.7

[56] References Cited

U.S. PATENT DOCUMENTS

| | | | |
|---|---|---|---|
| 874,714 | 12/1907 | Westcott | 19/65 A |
| 1,986,970 | 1/1935 | Naughey | 57/252 |
| 2,851,849 | 9/1958 | Merrill | 57/251 |
| 2,964,801 | 12/1960 | Riehl et al. | 19/65 A |
| 3,412,548 | 11/1968 | Poltorak . | |
| 3,712,682 | 2/1973 | Binder et al. | 406/70 |
| 3,930,286 | 1/1976 | Wornall | 19/97.5 X |
| 3,987,615 | 10/1976 | Hill | 57/400 |
| 4,019,225 | 4/1977 | Nayfa . | |
| 4,257,221 | 3/1981 | Feinberg | 57/256 |
| 4,860,407 | 8/1989 | Roess | 19/145.5 |
| 4,991,387 | 2/1991 | Tashiro et al. | 57/254 X |
| 5,007,136 | 4/1991 | Artzt et al. | 19/65 A |

FOREIGN PATENT DOCUMENTS

| | | |
|---|---|---|
| 1510304 | 7/1969 | Fed. Rep. of Germany . |
| 2575192 | 6/1986 | France . |

OTHER PUBLICATIONS

Documentation "Rieter Spinning Systems—product Range", published by Rieter Machine Works Ltd., located at 8406 Winterthur, Switzerland.

*Primary Examiner*—Daniel P. Stodola
*Assistant Examiner*—William Stryjewski
*Attorney, Agent, or Firm*—Sandler, Greenblum & Bernstein

[57] ABSTRACT

A method of and an apparatus for producing a blended yarn from cotton fibers and man-made or synthetic fibers. According to conventional methods the blending of cotton fibers and man-made fibers has been hitherto effected subsequent to a cotton combing process. In order to obtain an appropriate yarn quality, it is necessary to comb out the cotton and thereby separate the short fibers thereof. With the prior art method of bringing together or combining the blend constituents subsequent to the cotton combing process, there have been problems with regard to a homogeneous blending of cotton and man-made fibers. A great number of machines is thereby required and the corresponding constructional expenditure is high. Therefore, a method and an apparatus are suggested and according to which the two blend constituents, namely cotton fibers and man-made fibers, are already brought together or combined prior to the combing process. In this manner, there is obtained a homogeneous blend and a substantial reduction of the number of required machines is achieved.

5 Claims, 3 Drawing Sheets

PRIOR ART

METHOD OF AND APPARATUS FOR PRODUCING A BLENDED YARN FROM COTTON FIBERS AND MAN-MADE FIBERS

BACKGROUND OF THE INVENTION

The present invention relates to a new and improved method of, and apparatus for, producing a blended yarn from cotton fibers and man-made fibers.

In order to obtain a fine yarn quality, it is necessary that in a cotton combing process the short cotton fibers are combed out and separated. This applies to a quality high-grade pure cotton yarn as well as to a so-called blended or combination yarn, whereby another fiber material is spun with the cotton.

Conventional blending methods are known and mill-proven, whereby the blending of cotton fibers and man-made or synthetic fibers, is effected at a blend drafting arrangement subsequent to the cotton combing process. The combed-out cotton slivers together with the carded slivers of made-made or synthetic fibers, which carded slivers are possibly guided through a passage of drawing or drawing frame passage, are thereby doubled and then drafted and brought together or combined in a drafting unit or arrangement to form a single sliver. The sliver delivered from the blend drafting unit or arrangement, which sliver now consists of cotton fibers and man-made or synthetic fibers, is usually guided through two further following drafting units or arrangements in order to obtain, in accordance with the thereby effected doubling, a good blending of the cotton fibers with the man-made or synthetic fibers, while simultaneously laying the fibers in parallel with one another.

However, it became apparent that with the known methods or processes the expenditure of machinery employed, especially of passages of drawing or drawing frame passages, is relatively high, in order to obtain a homogeneous distribution of the cotton fibers and the man-made or synthetic fibers in the sliver, all the more so since it is difficult to blend the elastic man-made or synthetic fibers with the smooth cotton fibers. However, such homogeneous distribution is essential for the following spinning process and, in end effect, for the quality of the blended yarn. Furthermore, the blending has an influence upon the hairiness, the splitting and the fiber structure of the finished yarn.

SUMMARY OF THE INVENTION

Therefore, with the foregoing in mind, it is a primary object of the present invention to provide a new and improved method of, and apparatus for, producing a blended yarn from cotton fibers and man-made or synthetic fibers, and which method and apparatus do not exhibit the aforementioned drawbacks and shortcomings of the prior art.

Another and more specific object of the present invention aims at providing a new and improved method of, and apparatus for, producing a blended yarn from cotton fibers and man-made or synthetic fibers, and which method and apparatus render possible that an aimed-at or desired good blended-yarn quality is achieved, while affording a less extensive use of machines and a corresponding reduction of constructional expenditure.

Now in order to implement these and still further objects of the present invention, which will become more readily apparent as the description proceeds, the method aspects of the present development contemplate bringing together or combining in proportion to one another the cotton fibers and the man-made or synthetic fibers to form a fiber blend, conjointly combing the cotton fibers and the man-made or synthetic fibers of the fiber blend, conjointly drafting the combed fiber blend and subsequently spinning the drafted fiber blend to form a blended yarn.

The method aspects of the present development further contemplate blending the cotton fibers and the man-made or synthetic fibers in a fiber blending machine, whereby the thus resulting fiber blend is carded and subsequently doubled and drafted. The thereby formed card slivers are combined to form laps which are delivered to a combing machine for the combing-out process. Subsequent to the combing-out process there is only required one after-drafting step for doubling and drafting, before the thereby produced sliver is delivered to spinning machines for final spinning.

In accordance with a method variant of the present development which is manifested, among other things, by the aforementioned steps of bringing together or combining in proportion to one another the cotton fibers and the man-made or synthetic fibers to form a fiber blend, conjointly combing the cotton fibers and the man-made or synthetic fibers of the fiber blend, conjointly drafting the combed fiber blend and subsequently spinning the drafted fiber blend to form a blended yarn, the method aspects further contemplate separately carding the cotton fibers to form a carded cotton fiber sliver and the man-made or synthetic fibers to form a carded synthetic fiber sliver, and bringing together or combining the carded cotton fiber sliver and the carded sliver of man-made or synthetic fibers at a doubling and drawing passage. Laps formed from the thus blended fiber sliver are subsequently combed out at a following combing machine.

This method variant likewise contemplates undertaking, subsequent to the combing process, only one passage of drawing or drawing frame passage for doubling and drafting the combed slivers, before the slivers are delivered to the spinning machines.

As alluded to above, the invention is not only concerned with the aforementioned method aspects, but also deals with a new and improved apparatus for producing a blended yarn from cotton fibers and man-made or synthetic fibers.

According to the invention, a first exemplary embodiment of the apparatus constitutes a combination of machines and comprises a flock blending machine for blending cotton fiber flocks and man-made or synthetic fiber flocks and producing a flock blend, at least one card or carding machine for processing the flock blend and forming a card sliver, a preliminary drafting unit or arrangement for doubling and drafting the card sliver and forming a doubled sliver, a lap-forming machine for forming laps from the doubled sliver and a combing machine for processing the laps and combing out short cotton fibers to form combed slivers. The combing machine is advantageously followed by an after-drafting unit or arrangement for drafting and doubling the combed slivers and by a spinning machine for final spinning of the drafted slivers to form a blended yarn.

A second exemplary embodiment of the apparatus constructed according to the invention constitutes a combination of machines and comprises a card or carding machine for processing cotton fiber flocks and producing a carded cotton fiber sliver, a card or carding machine for processing man-made or synthetic fiber flocks and producing a carded man-made or synthetic fiber sliver, a blend drafting and doubling unit or arrangement for bringing together and blending the carded cotton fiber sliver and the carded sliver of man-made or synthetic fibers and thus producing a blended doubled sliver, a lap-forming machine for forming laps from the blended doubled sliver, and a combing machine for processing the laps and combing out short cotton fibers to form combed slivers. The combing machine is advantageously followed by an after-drafting unit or arrangement for drafting and doubling the combed slivers and a spinning machine for final spinning of the drafted doubled slivers.

The spinning machines can thereby consist of a rover or roving frame, of a flyer and subsequent ring spinning machine or of a rotor spinning machine or any other suitable spinning machines processing sliver.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the apparatus constituting a combination of machines for performing the inventive method of producing a blended yarn has been illustrated therein as is needed to enable one skilled in the art to readily understand the underlying principles and concepts of this invention.

Figure 1:
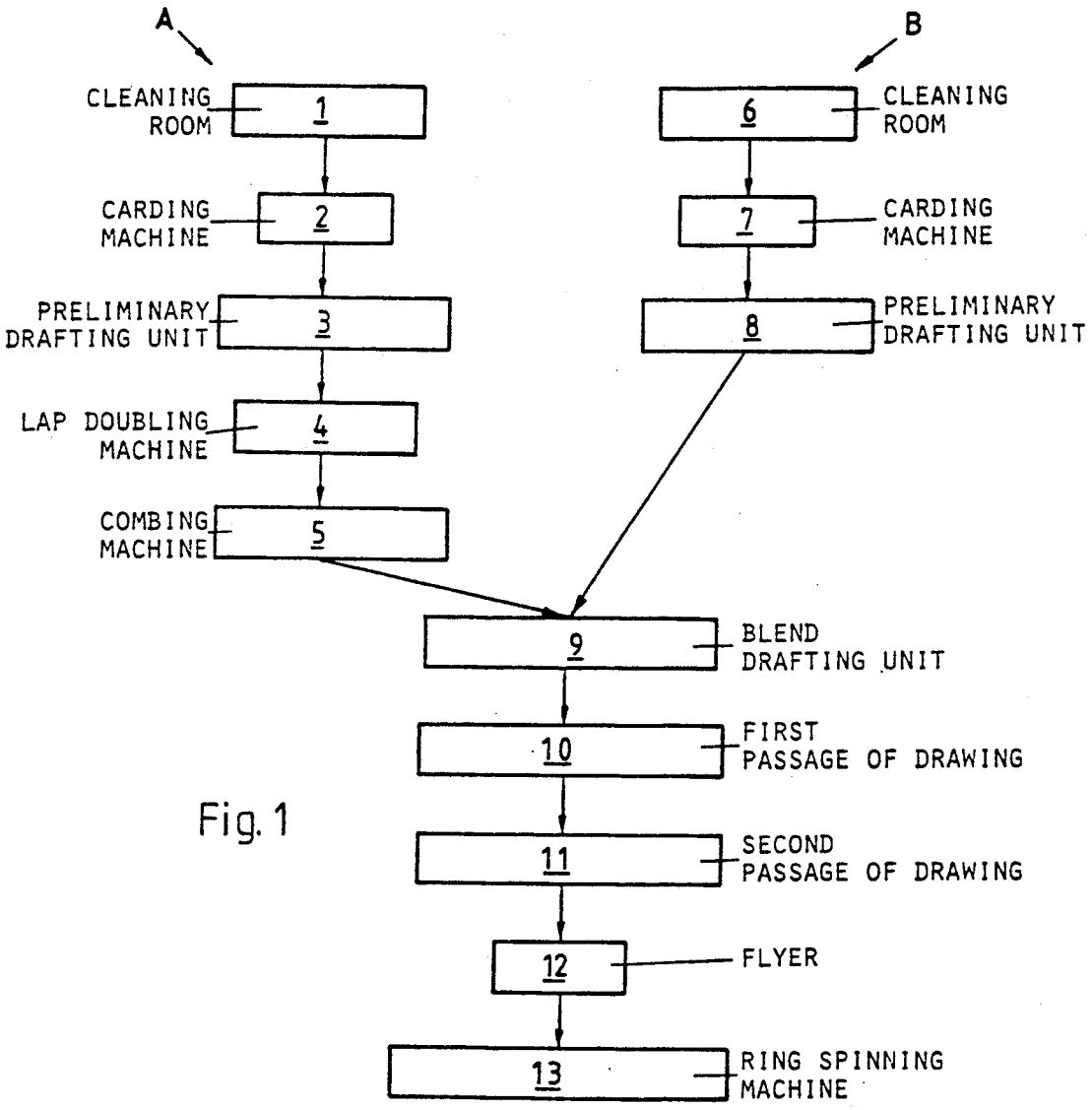
FIG. 1 shows a schematic flow chart of a combination or sequence of machines required for performing a conventional method of producing a blended yarn.

Turning attention now specifically to FIG. 1 of the drawings, there is schematically shown therein a conventional or prior art combination of machines for performing a conventional method of producing combed blended yarns. The combining or the blending of the cotton fibers and the man-made or synthetic fibers, for instance, polyester fibers, is effected in a blend drafting unit or arrangement 9.

However, before the two constituents, namely cotton fibers and polyester fibers, are blended, they are subject to different fiber processing methods A and B.

In the fiber processing method A, the cotton in the form of flocks arriving from a cleaning room 1 is passed on to cards or carding machines 2 for further processing.

The machinery in the cleaning room 1 generally comprises a bale-opening machine for opening cotton bales, a cleaning machine following thereat, an automatic cotton-blending machine for obtaining homogeneous blending of the cotton fiber material, and a further cleaning machine.

For reasons of simplicity and clarity these machines required for the cotton fiber processing method A have not been particularly illustrated in FIG. 1, particularly since such machines are well-known to the art.

Furthermore, these machines are disclosed in the technical documentation of the manufacturing program for short-staple spinning of Rieter Machine Works Ltd., located at 8406 Winterthur, Switzerland.

The aforementioned machinery provided in the cleaning room 1 can readily comprise a different combination or sequence of suitable machines.

The cotton card sliver delivered from the cards or carding machines 2 is doubled in a following preliminary drafting unit or arrangement 3. The doubling is effected fourfold or eightfold.

Laps are formed in a following lap doubling machine 4 from the cotton sliver leaving the preliminary drafting unit or arrangement 3, such laps being combed out in a following combing machine 5. The doubling effected in the lap doubling machine 4 is, for example, twenty-four-fold to thirty-two-fold.

A cleaning room 6 is the first work station for the polyester fibers in the fiber processing method B. Man-made or synthetic or, for instance in this case, polyester fiber bales are opened in the cleaning room 6 and the resulting polyester fiber flocks are delivered to a card or carding machine 7 for further processing. In this card or carding machine 7, the polyester fibers are wholly opened or loosened up to the individual or constituent fiber and aligned in the lengthwise direction, thus forming a card sliver as in the cards or carding machines 2 of the fiber processing method A. This card sliver consisting of pure polyester fibers is doubled sixfold to eightfold in a following preliminary drafting unit or arrangement 8.

The polyester sliver leaving the preliminary drafting unit or arrangement 8 is doubled and blended in a subsequent blend drafting unit or arrangement 9 with the cotton sliver leaving the combing machine 5. As a rule, the doubling is effected sixfold to eightfold.

The sliver leaving the blend drafting unit or arrangement 9 now comprises two constituents, namely cotton and polyester. In order to achieve an adequate blending and evenness of the sliver, the latter is guided through two following passages of drawing or drawing frame passages 10 and 11. The doubling in these two passages of drawing 10 and 11 is usually sixfold in each passage.

Subsequent to or downstream of the second passage of drawing 11 there is provided a flyer 12, in which a so-called roving is formed from the doubled sliver. The thus formed roving is spun to finished yarn on a following ring spinning machine 13. It is also conceivable that the sliver is directly supplied from the second passage of drawing 11 to a sliver-processing spinning machine, for example, a rotor spinning machine for yarn manufacture.

The actual blending process or operation according to this conventional method is effected in the blend drafting unit or arrangement 9 as well as in the two following passages of drawing 10 and 11. With eightfold doubling in the blend drafting unit or arrangement 9 and sixfold doubling in each of the passages of drawing 10 and 11, there is effected a total doubling of two hundred and eighty-eight-fold.

It is apparent from practical experience that this total doubling is often insufficient to achieve, as viewed across the cross-section of the sliver, a homogeneous distribution of the two fiber materials. In order to increase the doubling number, it would be conceivable to provide a further passage of drawing. However, this further passage of drawing results in technological disadvantages, particularly with regard to the adhesion of the sliver. It has become evident that with this conventional method or process for producing a blended yarn a limit has been reached with respect to the yarn quality.

It is here that the inventive method is advantageously employed. Two exemplary embodiments of the apparatus constructed according to the invention and for practising the inventive processes are hereinafter described in greater detail.

Figure 2:
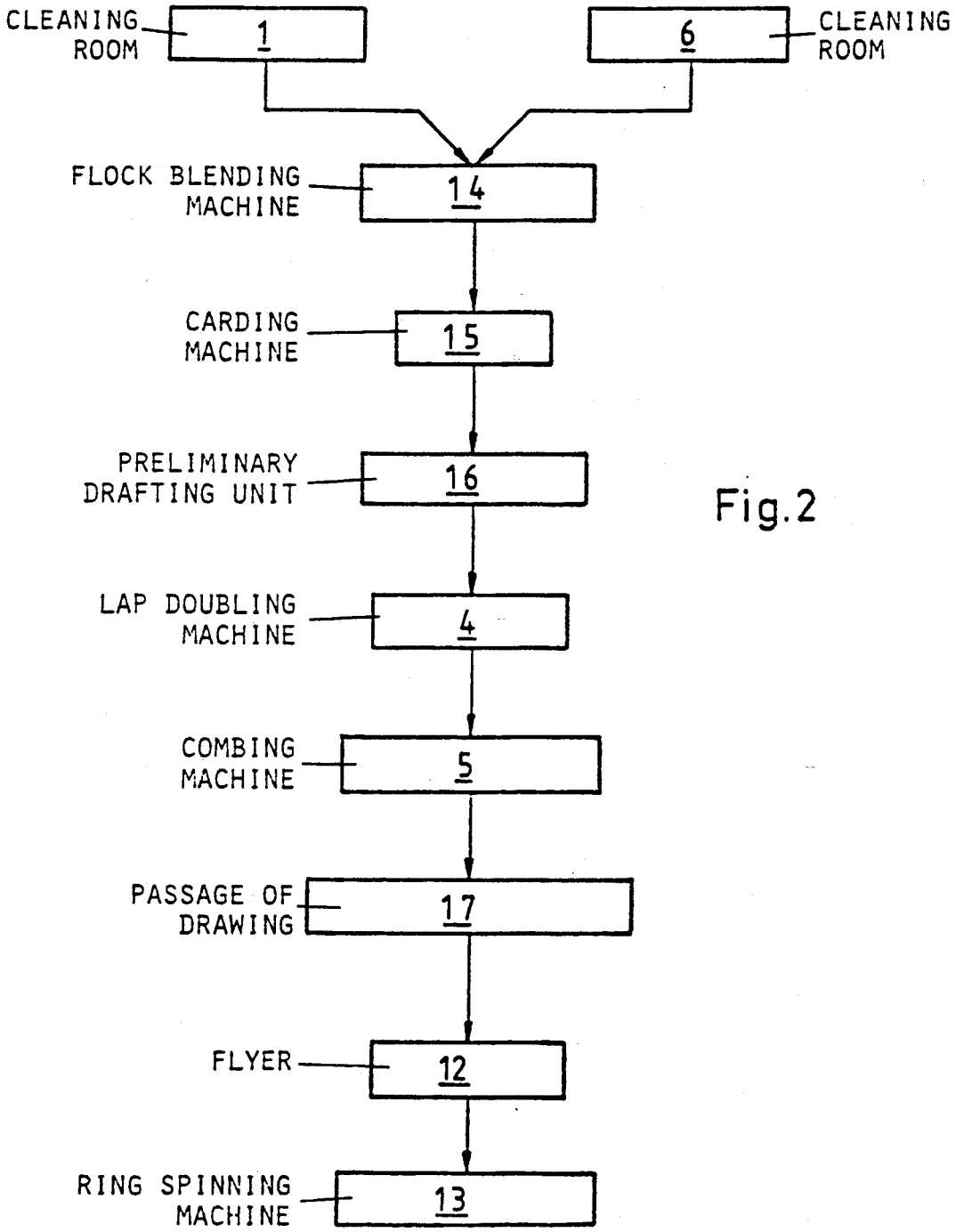
FIG. 2 shows a schematic flow chart of a first combination or sequence of machines required for performing the inventive method of producing a blended yarn.

In FIG. 2 there is schematically illustrated a first combination or sequence of machines required for performing the inventive method of producing a blended yarn, whereby both materials, namely cotton and polyester, undergo the first process step in the cleaning rooms 1 and 6, respectively, as hereinbefore described in conjunction with conventional procedure. The fiber flocks delivered from the cleaning or opening rooms 1 and 6 are subsequently blended in a blending plant or installation 14, a so-called flock blending machine. The proportion of cotton in the fiber blend and the proportion of polyester in the fiber blend can be preselected as desired. The flock blend or mixture is conveyed to a card or carding machine 15 and is processed thereat. The card clothing is set such that both blend constituents are taken into consideration. Consequently, compromises are possibly necessary.

The sliver delivered from the card or carding machine 15 is doubled fourfold to eightfold in a preliminary drafting unit or arrangement 16. As in the case of the conventional method or process, the doubled sliver is processed in the following lap doubling machine 4 to form laps. These laps, which consist of a homogeneous blend of cotton and polyester, are supplied to the following combing machine 5 for the combing process, which is carried out essentially for combing out and removing the short cotton fibers. The proportion of short polyester fibers, which are likewise combed out, is relatively very small and depends directly on the short-fiber proportion of the polyester fibers of the preceding process steps.

The technology of present day combing machines ensures that no long fibers are combed out, whereby no loss results by simultaneously combing out the proportion of polyester in the fiber blend. The combing-out process of a blend of cotton/man-made fibers results in a shortening of the process with respect to the number of machines required and in a higher yarn quality and, consequently, in a more economical manufacturing process.

As a result of the already intensively effected blending of the cotton fibers and the polyester fibers, it is possible that, subsequent to the combing process, only one passage of drawing or drawing frame passage 17 is required.

The sliver delivered from the passage of drawing 17 is passed on, as hereinbefore described, to the flyer 12 and the following or subsequent ring spinning machine 13, in which the yarn is finally spun.

If a parallel is now drawn to the conventional method or process with regard to the blending or doubling of the two blend constituents, it is readily conceivable that the doubling in accordance with the inventive method is considerably higher. Supposing a sixfold doubling for the preliminary drafting unit or arrangement 16, a thirtyfold doubling at the lap doubling machine 4, an eightfold doubling at the combing machine 5 and an eightfold doubling in the passage of drawing 17, then there is achieved a total doubling of eleven thousand five-hundred and twenty. This comparison alone shows that, in contrast to the conventional method or process, a substantially higher degree of blending or mixing can be obtained with respect to the blending of the two constituents. The blending of the two constituents already effected in the form of flocks in the mixing plant or flock blending machine 14 results in an extraordinarily homogeneous distribution of the two constituents across the cross-section of the sliver.

Figure 3:
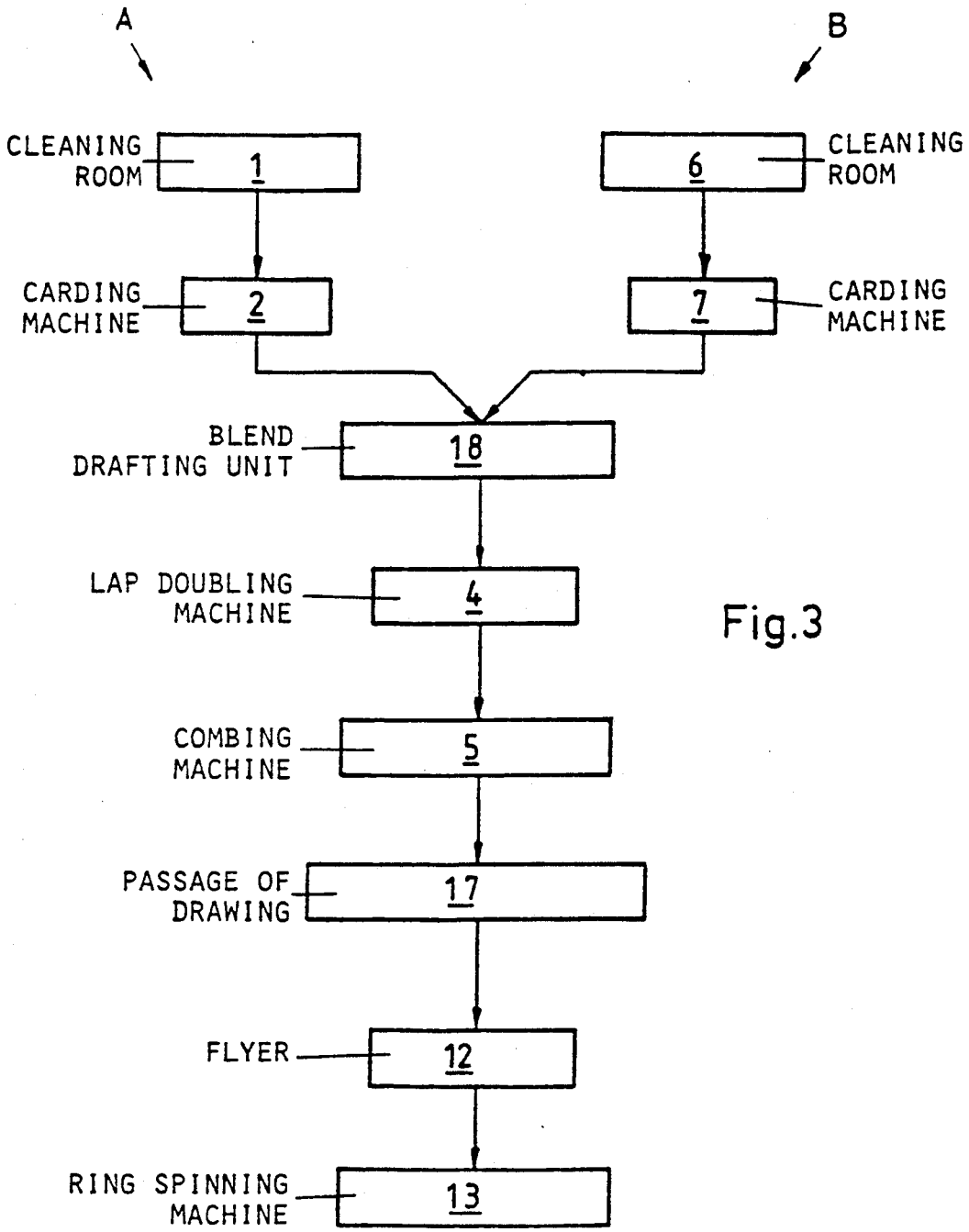
FIG. 3 shows a schematic flow chart of a second combination or sequence of machines required for performing the inventive method of producing a blended yarn.

FIG. 3 shows a further exemplary embodiment of a combination or sequence of machines required for performing the inventive method of producing a blended yarn, whereby the cotton in the form of flocks, after leaving the cleaning or opening room 1, is passed on to the card or carding machine 2 for further processing. The man-made or synthetic or chemical fibers, for instance the polyester, leave the cleaning or opening room 6 likewise in the form of flocks and arrive at the card or carding machine 7, where a polyester sliver is formed.

The bringing together or combining of cotton and polyester is effected subsequent to the cards or carding machines 2 and 7, whereby the delivered card slivers are brought together or combined in a blend drafting unit or arrangement 18 and doubled thereat. The further processing method for the sliver delivered from the blend drafting unit or arrangement 18 corresponds with the process following the preliminary drafting unit or arrangement 16 and already hereinbefore described in conjunction with the first combination or sequence of machines depicted in FIG. 2. In other words, directly downstream of the blend drafting unit or arrangement 18, there follow the lap doubling machine 4, the combing machine 5, the passage of drawing or drawing frame passage 17, the flyer 12 and the ring spinning machine 13. The total doubling effected by the exemplary embodiment depicted in FIG. 3 corresponds with the total doubling effected with the exemplary embodiment depicted in FIG. 2.

In the exemplary embodiment of apparatus constructed according to the invention and illustrated in FIG. 3, the bringing together or combining of cotton and polyester is effected in the form of carded slivers. The blending of the two constituents in the form of flocks (FIG. 2) may provide better blending or mixing, but compromises must be taken into account in the selection of the card clothing and in the setting of the card clothing, in the event that both materials are simultaneously processed on one and the same card or carding machine.

This disadvantage is overcome in the method or process performed by the apparatus schematically depicted in FIG. 3 in that the cotton as well as the polyester are processed with a special card clothing adapted to the respective material. Consequently, no compromises are required with respect to the setting and the production of the cards or carding machines 2 and 7.

By the inventive method, whereby the proportion of cotton in the fiber blend and the proportion of polyester in the fiber blend are already brought together prior to or upstream of the combing process and subsequently conjointly combed, it is possible that, on the one hand, homogeneous yarn can be achieved in the blend and that, on the other hand, a reduction in the number of required machines can be obtained. As can be seen from the embodiments depicted in FIGS. 1, 2 and 3, the performance of the conventional method or process requires 13 machine units, while the performance of the inventive method requires only 10 machine units.

While there are shown and described present preferred embodiments of the invention, it is to be distinctly understood that the invention is not limited thereto, but may be otherwise variously embodied and practiced within the scope of the following claims.

Accordingly, what we claim is:

1. A method of producing a blended yarn from cotton fibers and synthetic fibers, comprising the steps of:

combining in a predetermined proportion to one another the cotton fibers and the synthetic fibers to form a fiber blend;

forming laps with the fiber blend, for combing;

conjointly combing the cotton fibers and the synthetic fibers of the fiber blend;

conjointly drafting the cotton fibers and the synthetic fibers of the fiber blend; and spinning the fiber blend to form a blended yarn.

2. A method of producing a blended yarn from cotton fibers and synthetic fibers, comprising the steps of:

blending the cotton fibers and the synthetic fibers in a predetermined proportion to one another in a blending machine to form a fiber blend;

carding the fiber blend to form a card sliver;

forming laps from the card sliver, for combing;

combing the laps of the card sliver to form combed slivers;

drafting and doubling the combed slivers to form drafted slivers; and spinning the drafted slivers to form a blended yarn.

3. A method of producing a blended yarn from cotton fibers and synthetic fibers, comprising the steps of:

carding the cotton fibers to form a carded cotton fiber sliver;

carding the synthetic fibers to form a carded synthetic fiber sliver;

combining in a predetermined proportion to one another said carded cotton fiber sliver and said carded synthetic fiber sliver at a blend drafting and doubling arrangement and producing a blended sliver;

forming laps from the blended sliver, for combing;

combing the laps of the blended sliver to form combed slivers;

drafting and doubling the combed slivers to form drafted slivers; and spinning the drafted slivers to form a blended yarn.

4. An apparatus for producing a blended yarn from cotton fiber flocks and synthetic fiber flocks, comprising:

a flock blending machine for blending the cotton fiber flocks and the synthetic fiber flocks and producing a flock blend;

a card for receiving the flock blend produced by the flock blending machine and processing said flock blend and forming a card sliver;

a preliminary drafting arrangement for doubling and drafting said card sliver and forming a doubled sliver;

a lap forming machine for forming laps from said doubled sliver;

a combing machine for processing said laps and combing out short cotton fibers to form combed slivers;

an after-drafting arrangement for drafting and doubling said combed slivers to form drafted doubled slivers; and a spinning machine for spinning said drafted doubled slivers to form a blended yarn.

5. An apparatus for producing a blended yarn from cotton fiber flocks and synthetic fiber flocks, comprising:

a card for processing cotton fiber flocks;

said card processing cotton fiber flocks producing a carded cotton fiber sliver;

a card for processing synthetic fiber flocks;

said card processing synthetic fiber flocks producing a carded synthetic fiber sliver;

a blend drafting and doubling arrangement for receiving the carded cotton fiber sliver and the carded synthetic fiber sliver from said cards and blending said carded cotton fiber sliver and said carded synthetic fiber sliver and producing a blended doubled sliver;

a lap forming machine for forming laps from said blended doubled sliver;

a combing machine for processing said laps and combing out short cotton fibers to form combed slivers;

an after-drafting arrangement for drafting and doubling said combed slivers to form drafted doubled slivers; and a spinning machine for spinning said drafted doubled slivers to form a blended yarn.

* * * * *